US005791966A

United States Patent [19]

Capps et al.

[11] Patent Number: 5,791,966

[45] Date of Patent: Aug. 11, 1998

[54] ROTATING TOY WITH ELECTRONIC DISPLAY

[75] Inventors: Stephen P. Capps, San Carlos; Raymond H. DuFlon, Woodside, both of Calif.

[73] Assignee: Noise Toys, Inc., Woodside, Calif.

[21] Appl. No.: 598,816

[22] Filed: Feb. 9, 1996

[51] Int. Cl.[6] ..... A63H 1/22; A63H 1/24; F21P 1/00; G09F 3/04

[52] U.S. Cl. ..... 446/242; 446/244; 446/256; 302/252; 40/452

[58] Field of Search ..... 446/47, 242, 243, 446/244, 245, 256, 258, 175, 409, 484, 485; 362/252; 40/442, 452, 542, 463; 345/31

[56] References Cited

U.S. PATENT DOCUMENTS

| | | | |
|---|---|---|---|
| 2,746,756 | 5/1956 | Sitton, Jr. | 446/485 X |
| 2,794,298 | 6/1957 | Mason | 446/485 X |
| 3,278,182 | 10/1966 | Lescher | 446/244 X |
| 4,470,044 | 9/1984 | Bell . | |
| 4,562,516 | 12/1985 | Chastain | 362/252 X |
| 4,563,160 | 1/1986 | Lee . | |
| 4,925,424 | 5/1990 | Takahashi | 446/175 |
| 5,036,442 | 7/1991 | Brown | 362/252 X |
| 5,041,947 | 8/1991 | Yuen et al. | 345/31 X |
| 5,045,016 | 9/1991 | Stern et al. | 446/409 |
| 5,145,444 | 9/1992 | Van Kuiken | 446/242 |
| 5,190,491 | 3/1993 | Connelly . | |
| 5,356,328 | 10/1994 | HO | 446/242 |
| 5,406,300 | 4/1995 | Tokimoto et al. | 345/31 |

FOREIGN PATENT DOCUMENTS

| | | | |
|---|---|---|---|
| 402061693 | 3/1990 | Japan | 40/542 |
| 402213892 | 8/1990 | Japan | 345/31 |
| 403036589 | 2/1991 | Japan | 346/31 |
| 405184729 | 7/1993 | Japan | 446/485 |
| 406242732 | 9/1994 | Japan | 40/542 |
| 2277189 | 10/1994 | United Kingdom | 345/31 |

OTHER PUBLICATIONS

WWW Page –HTTP://www.Brouhaha.COM/eric/Pic/Whirlesgig.HTML Note Doed Jun. 4, 1995 RE: "Floating" Cylinder To Display LED Messages.

"Stamp Applications" Article on pp. 11–13 in the Apr. 1996 Issue of Nuts & Volts.

The Little Book of Tops–Don Olney–Running Press–©1995 Collectors Digest–1995–LW Book Sales.

"In the Eye of The Beholder" B Shaun J. Greane Issue #43 –The Computer Applications Journal.

*Primary Examiner*—D. Neal Muir

*Attorney, Agent, or Firm*—Robin Diane Goldstein

[57] ABSTRACT

A rotating object, such as a toy top or yo-yo, is provided with a display mechanism which permits the display of letters, number and graphics as the object moves. In one embodiment a toy top is taught which incorporates such a display made up of string of light emitting diodes. As the top is spun a switch is closed by centrifugal force which activates the display circuitry. A message previously stored in the display circuitry memory is then read out of memory and is used to control the illumination of the LED's. As the top reaches a revolutionary speed which is in synchronization with the clocking speed of the display, the message is viewable by the user, and remains viewable until the rotational speed of the top slows enough to defeat the visual synchronization. Alternative embodiments are provided which permit the message to be displayed to be chosen at random or by further incorporating a photosensor which may read a message which has been encoded in a bar code or other visual code, and using the barcode to program the action of the display or provide a synchronization mechanism to enable the display to be continuously viewable over a wide range or rotation speeds.

16 Claims, 18 Drawing Sheets

ROTATING TOY WITH ELECTRONIC DISPLAY

TECHNICAL FIELD

This invention relates generally to toys, and more particularly to a top, yo-yo or other toy that rotates or moves in a periodic fashion, and which incorporates an electronic display.

BACKGROUND OF THE INVENTION

Tops and yo-yo's have served as toys for children for many years but, until quite recently, they have been purely mechanical devices. A walk though a toy store will show that among tops and yo-yo's the variations are many, but, in general, there is usually a rotating body that is put into motion though the use of a string and, often, the energy of a young arm. With respect to tops, there have been, over the years, various mechanical contrivances to assist in spinning the top to a higher speed or make, in some cases, to make it easier for younger children to spin and have fun. In a similar vein, in recent years, a yo-yo with a mechanical clutch has become popular which enables any operator to easily make the yo-yo "sleep" (that is, to spin at the bottom of the string before returning to the operator's hand.)

In addition to these mechanical improvements, during the past few decades, with the development of small batteries and miniaturized electronics, a few electrified tops and yo-yo's have been produced. The simplest example of such a toy consists of some lights that are illuminated when the top or yo-yo is spun such that a lighted display is produced. In addition, in some cases sound effects have been added with the simple addition of a "sound chip" to produce music while the body spins.

While these additional features are interesting, in practice they lack enough appeal to capture the operator's attention beyond a few minutes. However, by using modern microelectronic displays and circuitry, new and more entertaining toys featuring a far-richer set of features has become possible.

Accordingly, it has been determined that the need exists for an improved electronic toy which overcomes the aforenoted limitations and which further takes advantage of, and provides capabilities, features and functions, not available with traditional tops, yo-yo's and toys.

SUMMARY OF THE INVENTION

Generally speaking, in accordance with the invention, a rotating toy such as a top or yo-yo is provided with an electronic display to display alphanumeric characters and/or graphics. A mechanism for programming the display is also provided. In operation, the operator spins the toy, or otherwise sets it in motion, and the display sweeps out an image on at least one face of it. The image is generated by employing at least a single line of display elements (pixels) located proximate to the radius of the rotating body. By rapidly and correctly pulsing the display elements, virtually any image can be formed in a manner similar to that used to draw a raster on a television set. Almost any image may be displayed, limited only by the number of display elements are in the array, their optical characteristics, how the display elements are spatially arranged and how they are modulated.

One embodiment of the invention is a standard toy top with a row of seven LED's on the radius of the top face of the top. As the top spins, the LED's are pulsed to form 5×7 dot matrix characters as seen in many electronic signs.

In another embodiment a yo-yo is the spinning body and there are five LED's are on the edge of one half of the yo-yo. By spinning the yo-yo, the operator and others can see the message as it vertically scrolls by. Similar to the toy top embodiment described above, the display can be on the face of the yo-yo.

Another embodiment is a device that attaches to a automobile wheel's hubcap. As the wheel rotates, the LED's display a message.

Another embodiment is a top as described above, which further incorporates a photosensor used to decode a bar code or other visually encoded information. In this embodiment, when the invention is spun over bar code, it synchronizes the character display with the rotational speed. The code may also be used to program the invention to display a particular message.

Another embodiment is a top with a spiral of seven LED's located proximate to the upper face of the top. As the top spins, the LED's are pulsed to form 5×7 dot matrix characters as seen in many electronic signs. However, this embodiment differs from a radially aligned row in that the images formed while the top spins are more pleasant. In addition, the message is harder to decode until the rotation spin is synchronized with the display.

Still other objects and advantages of the invention will, in part, be obvious and will, in part, be apparent from the specification.

The invention accordingly comprises the features of construction, combinations of elements and arrangements of parts which will be exemplified in the constructions hereinafter set forth, and the scope of the invention will be indicated in the claims.

Accordingly, by employing the teachings of the invention a novel, low-cost method and mechanism for adding a rich message and display capability to rotating objects, such as toys with rotating parts, is provided which overcomes the limitations of earlier solutions, providing enhanced applications for advertising, holiday greeting, fortune telling, time telling, and the like.

BRIEF DESCRIPTION OF THE DRAWINGS

For a fuller understanding of the invention, reference is had to the following descriptions taken in connection with the accompanying drawings, in which.

NOTATION AND NOMENCLATURE

The detailed description that follows is presented largely in terms of computational descriptions and the symbolic representations of operations on data bits and data structures within a computer memory. These descriptions and representations are the means used by those skilled in the data processing arts to most effectively convey in substance their work to others skilled in the art.

A computational process is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bit patterns, values, elements, symbols, characters, data packages, or the like. It should be borne in mind, however, that all of these and similar terms are to be associated with the appropriate physical quantities and are merely convenient labels applied to these quantities.

Further, the manipulations performed are often referred to in terms, such as adding or comparing, that are commonly associated with mental operations performed by a human operator. No such capability of a human operator is necessary, or desirable in most cases, in any of the operations described herein that form part of the present invention; the operations are machine operations. Useful machines for performing the operations of the present invention include general purpose digital computers or other similar devices. In all cases there should be borne in mind the distinction between the method of operations in operating a computer and the method of computation itself. The present invention relates to method steps for operating a computer in processing electrical or other (e.g. mechanical, chemical) physical signals to generate other desired physical signals.

The present invention also relates to an apparatus for performing these operations. This apparatus may be specially constructed for the required purposes, or it may comprise a general purpose computer as selectively activated or reconfigured by a computer program stored in the computer. The calculations presented herein are not inherently related to any particular computer or other apparatus. In particular, various general purpose machines may be used with programs written in accordance with the teachings herein, or it may prove more convenient to construct a more specialized apparatus to perform the required method steps. The required structure for a variety of these machines will appear from the description given below.

DETAILED DESCRIPTION OF THE PREFERRED EMBODIMENTS

Figure 1:
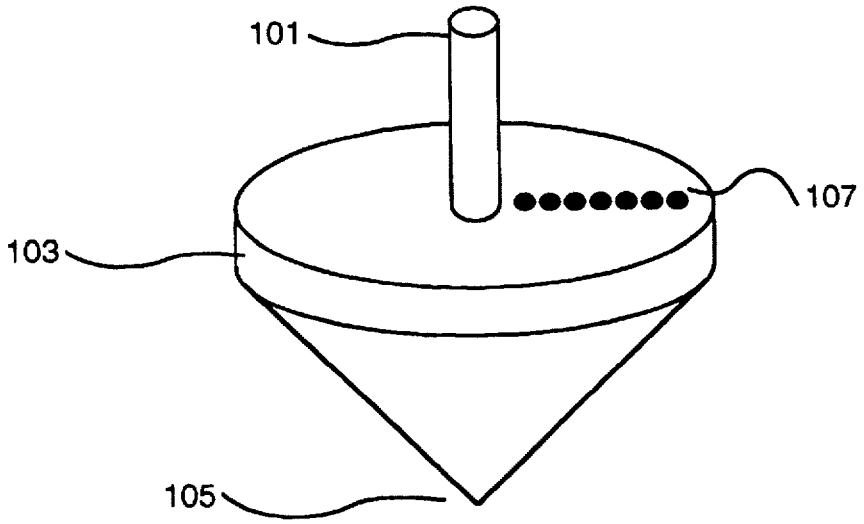
FIG. 1 is a diagram of a typical top-like device according to one embodiment of the present invention.

Referring first to FIG. 1, there is shown a diagram of a top-like device constructed in accordance with one embodiment of the present invention. A typical top is rotated by grasping the handle 101 and spinning the body 103. It will then rotate around and balance on a point 105. In this embodiment of the present invention, there is a row of seven light emitting diodes (LEDs) 107 for displaying the message.

Figure 2:
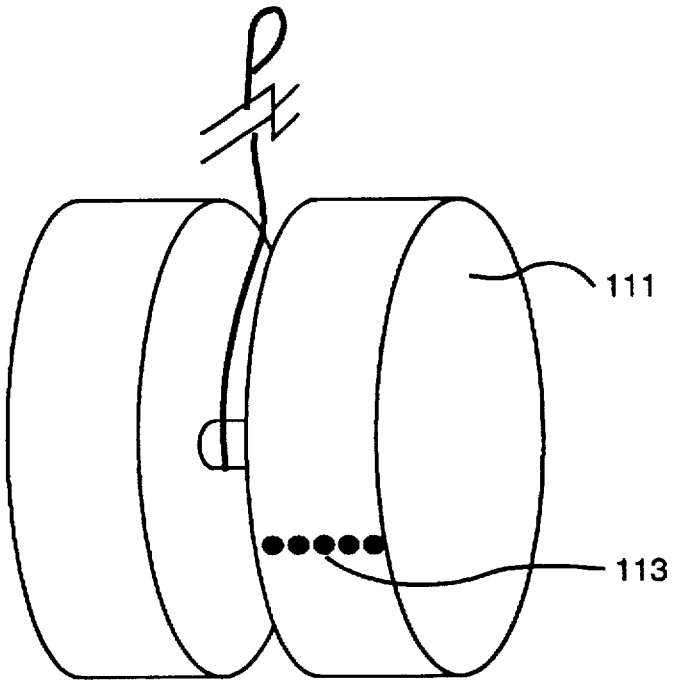
FIG. 2 is a diagram of a typical yo-yo-like device with an edge display according to one embodiment of the present invention.

Referring now to FIG. 2, there is shown a diagram of a yo-yo-like device. In this embodiment the traditional body of the yo-yo 111 further incorporates a battery and associated circuitry to drive the display LEDs 113 which are located along end of the yo-yo body. In this embodiment, only 5 LEDs are needed because the characters are display vertically.

Figure 3:
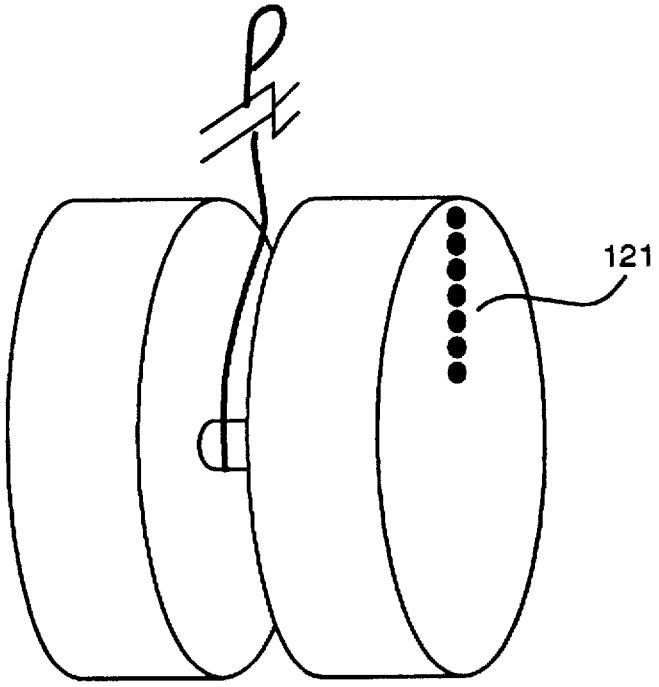
FIG. 3 is a diagram of a typical yo-yo-like device with an side display according to one embodiment of the present invention.

Referring now to FIG. 3, there is shown a diagram of a different yo-yo-like device constructed in accordance with the teachings of the invention. In this embodiment the display LEDs 121 are arranged on the face of the yo-yo. In this embodiment, seven LEDs are used because the characters are display horizontally.

Figure 4:
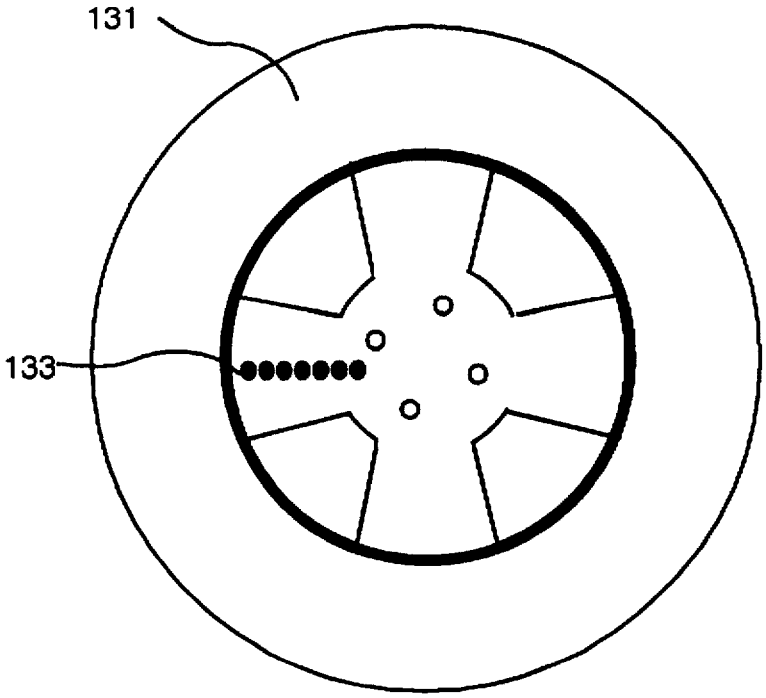
FIG. 4 is a diagram of a typical wheel hubcap device with a display according to one embodiment of the present invention.

Referring now to FIG. 4, there is shown a diagram of a wheel hubcap device for an automobile which incorporates the invention. The tire and wheel assembly 131 is typical to those found on any automobile. The hubcap contains an LED display 133 which is driven in according to this present invention.

Figure 5:
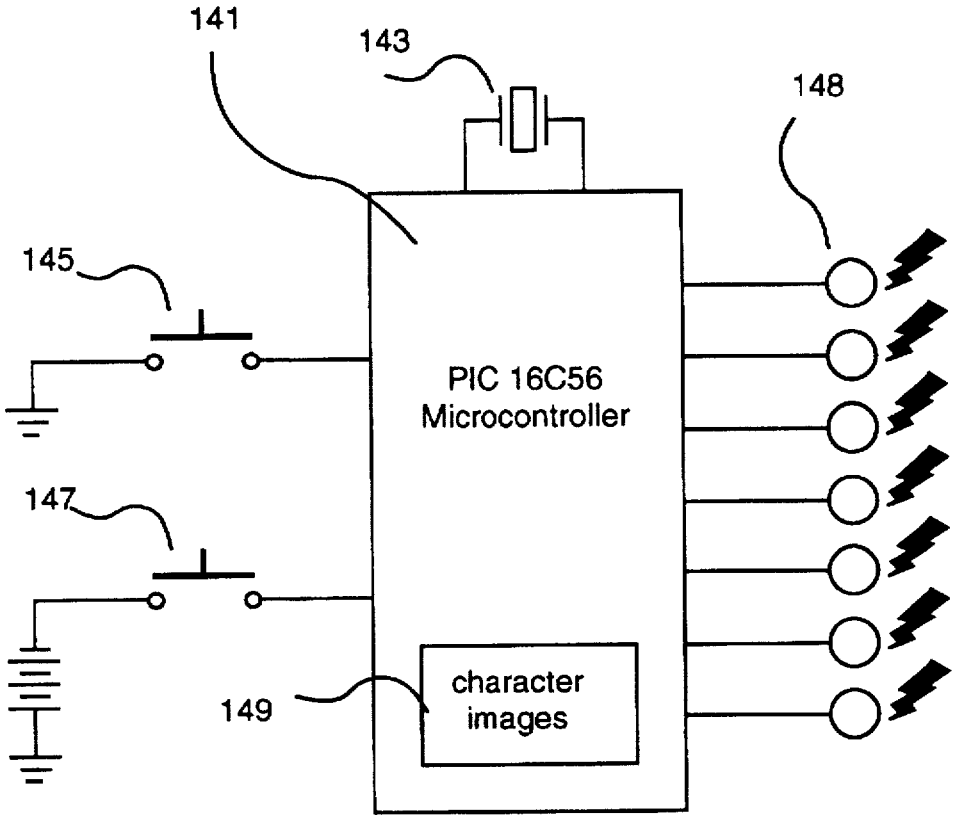
FIG. 5 is a block diagram of a typical electronic device according to one embodiment of the present invention.

Referring now to FIG. 5, there is shown a block diagram of the circuitry used to implement the preferred embodiment. A microcontroller 141 such as the PIC16C56 manufactured by Microchip Technology Inc. of Chandler, Ariz. is well suited for this task. Its clock signal is provided by a crystal 143. The display process is initiated when switch 147 is actuated to provide power to the circuitry. In some embodiments a switch 145 is further provided to permit synchronization of the display as the device rotates. In operation the microcontroller drives the LEDs 148 with signals which are derived from 5×7 dot matrix characters stored in the ROM 149 inside the microcontroller.

Figure 6:
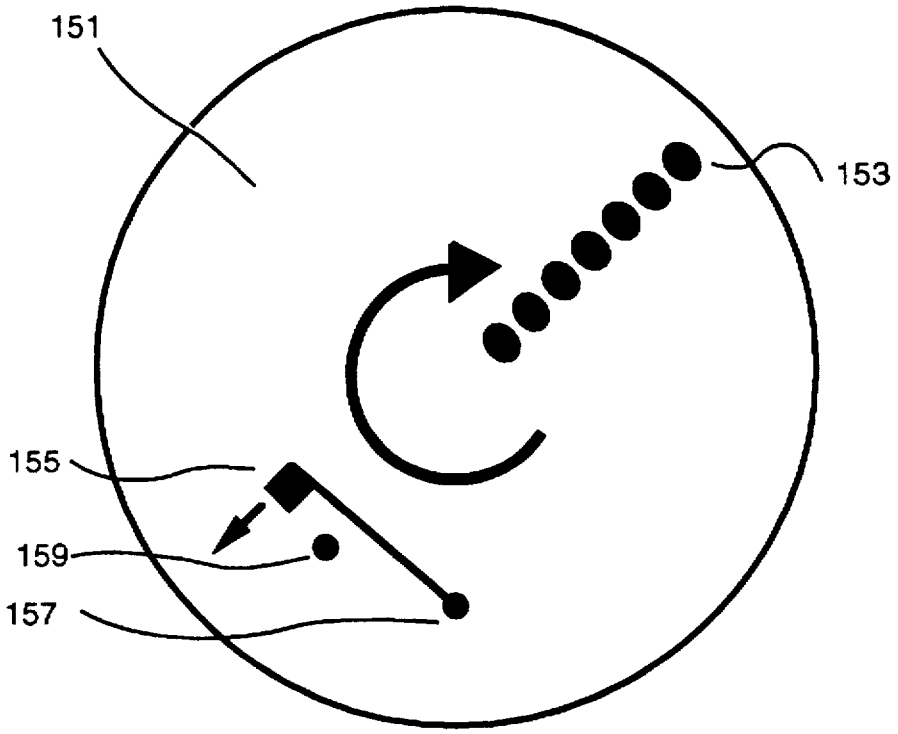
FIG. 6 is a top-view diagram of a typical circuit board for a top-like device with a typical centrifugal switch detail.

Referring now to FIG. 6, there is shown the top-view of a circuit board 151 constructed in accordance with the preferred embodiment. As illustrated, this board is affixed to the top so that it rotates around its center point. The LEDs 153 are illuminated to form the virtual image. The display is turned on when the switch 145 is closed. In this embodiment switch 145 comprises a strip of beryllium copper with a weight attached to one end 155 and fixed at the other end 157. As the top rotates, centrifugal force counteracts the force of the spring and permits the end of the spring to swing out as indicated against the contact 159. When this occurs, the circuit is completed and the microcontroller displays the message.

Figure 7:
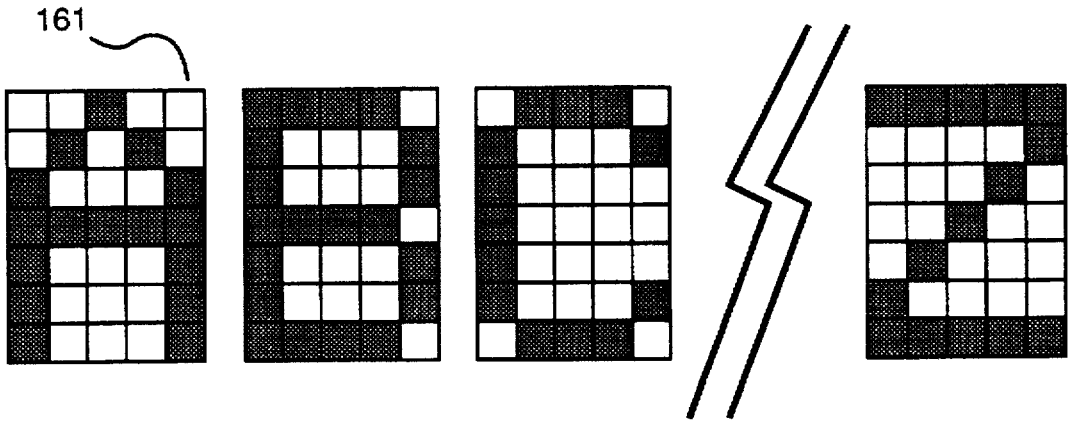
FIG. 7 is a diagram of a typical 5×7 dot matrix characters according to one embodiment of the present invention.

Referring now to FIG. 7, there is shown the encoding of text as 5×7 dot matrix characters 161. Uppercase characters are shown, but lower case characters and/or graphical symbols such as cartoon characters may also be stored.

Figure 8:
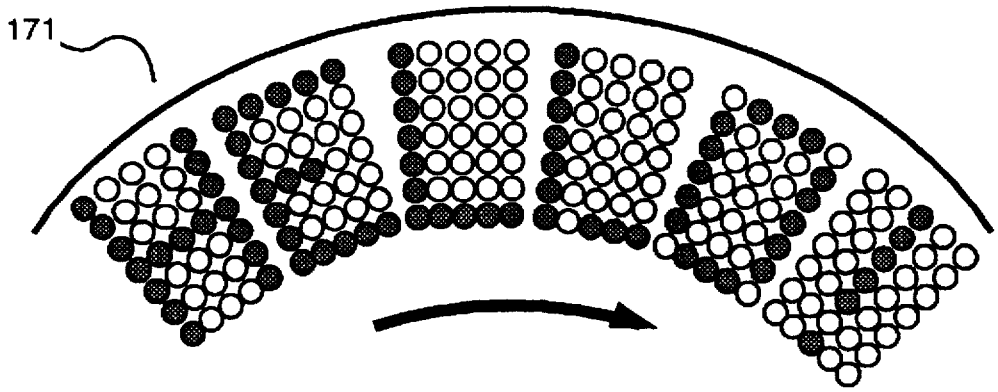
FIG. 8 is a portion of a typical display of a message containing the characters "HELLO!" as perceived by a viewer according to one embodiment of the present invention.

Referring now to FIG. 8, there is shown a typical display of the top while spinning. The invention relies on the human eye's persistence of vision to form an image from the rotating LEDs. In FIG. 8 a fragment of a message containing the characters "HELLO!" is shown.

Figure 9:
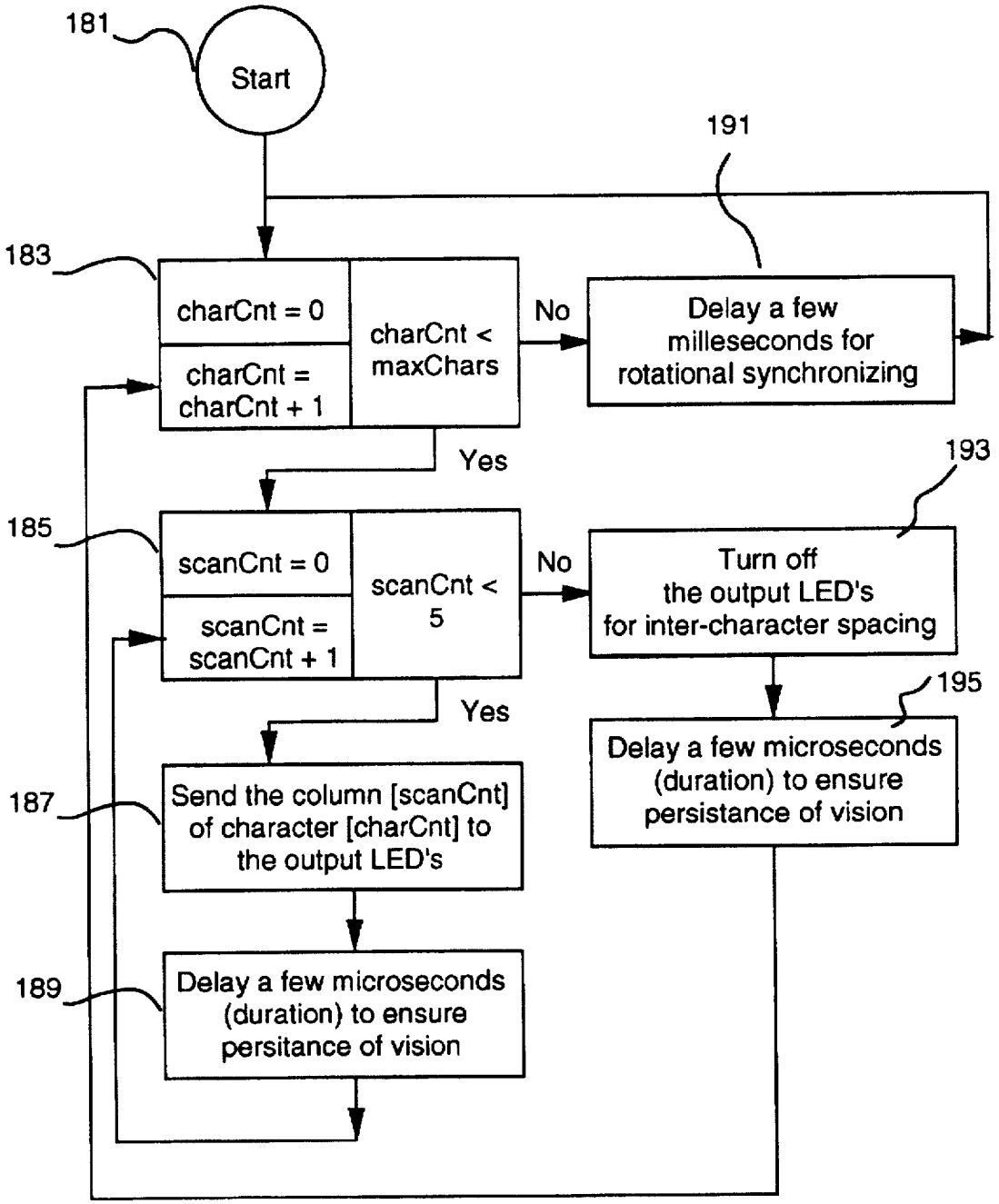
FIG. 9 is a flow chart illustrating the overall operating sequence according to the present invention subject to control by an operator.

Referring now to FIG. 9, there is shown the flowchart for the present invention. The invention's process begins when the microcontroller is reset 181. A message is stored along with the programming instructions. In this embodiment, the message length is 16 characters, but other messages of different lengths may be stored and displayed, depending on the amount of memory available, the number of display elements, and the rotational speed of the toy. Returning to the flowchart, for each character in the message, a loop is begun at step 183. The individual columns of the pixels from the 5×7 character codes 161 are displayed in a column-by-column fashion. The program loop shown in step 185 forms a scan line counter. In step 187 the processor controls signals to the LED's to display the appropriate column of the appropriate character from the message. The LED's must stay illuminated for a period of time long enough for the eye to perceive the image. This delay, called duration, is accomplished in step 189 and is about 250 microseconds in the preferred embodiment. The remaining scan lines are then displayed by returning to the loop in step 185. In this example there are five columns per character, so the loop is repeated the appropriate number of times to output the information needed for each column. Once the scan lines are all displayed, an inter-character gap is displayed in step 193. In this embodiment this gap is also a few hundred microseconds 195. After the character and its gap are displayed 171, the next character is started by returning to step 183 and this process is repeated until the entire message has been displayed. Finally, when the characters of the message have all been displayed, there is a few millisecond delay 191 before the whole process is repeated.

The delay times discussed in steps 189, 191, and 195 have been empirically derived from typical top rotational speeds reached in operation of the preferred embodiment, but are understood to have a far greater range of values depending on rotational speed, display technology and other circuit enhancements. In addition, since the top starts at one rotational speed and then slows down before toppling over, these delay times permit the display to be synchronized with the rotation of the top during some particular range of speed, and faster and slower rotation will cause the display to appear out of synch to the viewer. By increasing these delay times the display will be synchronized at slower speeds while decreasing the delay times will result in synchronization at higher speeds. It is noted that the other embodiments provided in FIGS. 2–4 may, therefore, incorporate different delay times. Alternatively, a mechanism may be employed which provides a reference to which the display timing may be synchronized. Such a mechanism may rely on optical, magnetic or other means and an embodiment incorporating such a mechanism is disclosed in connection with FIG. 10.

In addition, it is also to be understood that the delay time for the inter character gap 195 may be zero, which collapses the characters together. This may be especially useful for non-textual applications, such as applications which display graphics. Alternatively, another embodiment of the invention may store the characters with an inter-character gap in a 6×7 matrix. This will then eliminate the delay step 195 altogether.

Figure 10:
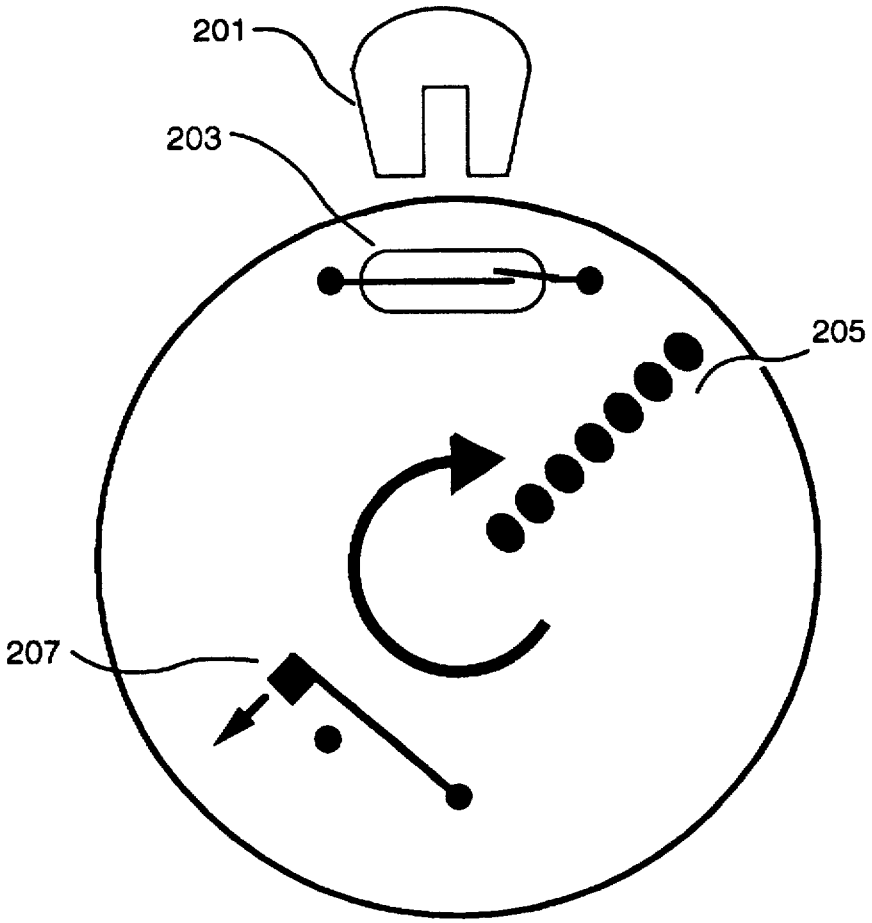
FIG. 10 is a diagram of a typical circuit board for an alternate embodiment of the present invention, a hubcap display device, with a typical reed- switch detail for rotational synchronization.

Referring next to FIG. 10, a diagram of a circuit board which may be used in an embodiment of hubcap device is shown. This embodiment of the invention does not permit the display to "free-run", as does the top application, because in such a case the text would only be readable at one vehicle speed. Therefore, it is understood that a synchronizing method is needed. One such synchronization mechanism incorporates a magnet 201 which is fixed to the axle of the wheel so that is does not rotate. As the wheel rotates, the magnet will exert an influence on a reed-switch 203 and cause it to close once per rotation. The reed-switch operates as is the synchronization switch 145 illustrated in FIG. 5 and described in that figure's explanation above. In addition, the LEDs 205 and centrifugal switch 207 are incorporated into this embodiment as described in FIG. 6. Finally, in this embodiment the flowchart of FIG. 9, may be used with the modification that the delay loop 191 would be replaced by a loop that waits for the reed-switch to close.

Figure 11:
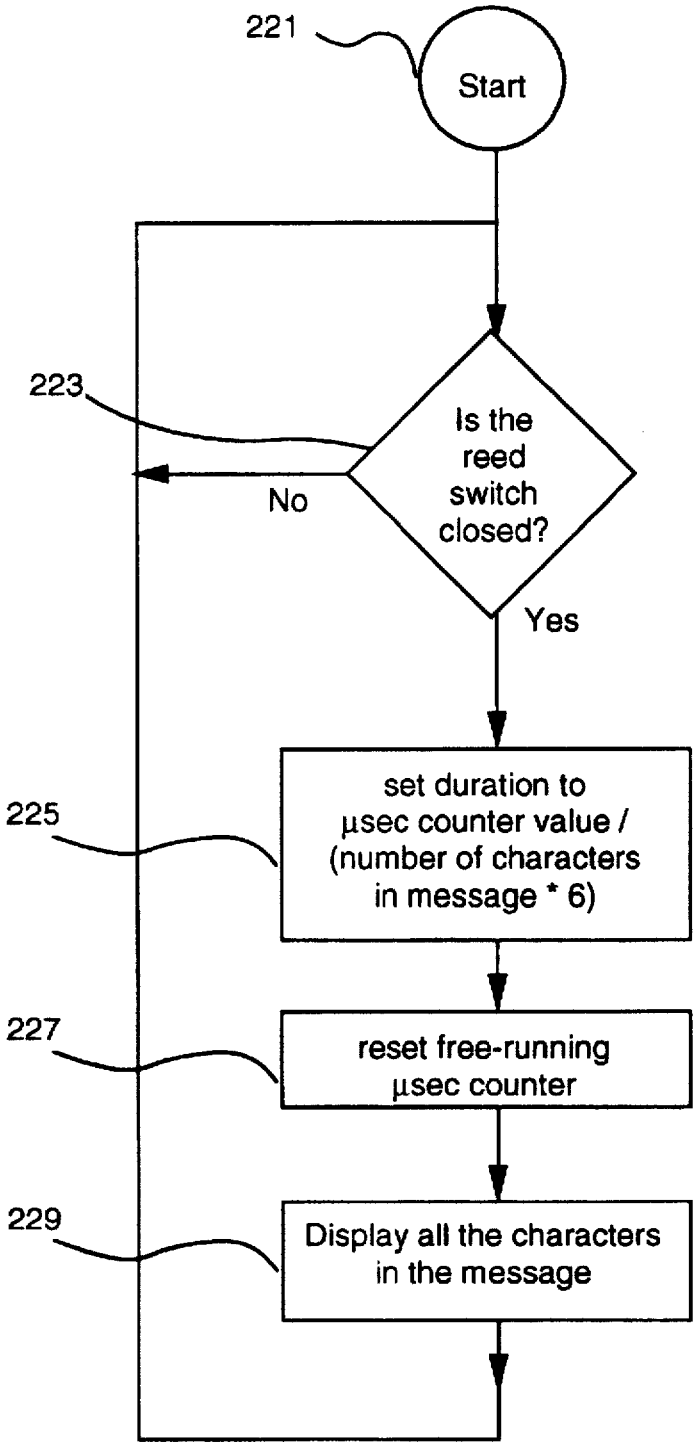
FIG. 11 is a flow chart illustrating the overall operating sequence according to the hubcap display embodiment of the present invention.

Referring now to FIG. 11, there is shown the flowchart for the hubcap device embodiment of the present invention. This as indicated earlier, the implementation of this process builds upon that described in FIG. 8. The process begins when the microcontroller is reset 221. Step 223 provides a loop where the process waits until the reed switch closes which signifies the beginning of a new rotation. Since the duration of the LED illumination is dependent upon the rotational speed, that speed must be determined. Microcontrollers typically have one or more free-running counters available which may be used for this purpose. By reading and then resetting such counter, the number of microseconds each revolution takes can be easily determined, and each cycle through the main loop 223 will be recognized as one rotation. Moving forward, in FIG. 11, step 225 reads the value of the timer and divides it by the total number of scans per rotation to determine the duration of each scan line. The total number of scans per rotation is calculated as the number of characters multiplied by the number of scans per character; in this embodiment there are 6 scans per character. The counter is then reset to zero in step 227 to set it up for the next rotation, and the message to be displayed is presented to the LED's as described above. Step 229 may be understood to encompass all the steps taught in FIG. 9, except step 191. Those steps cycle through all scan lines of all characters and illuminate the LED's accordingly. The final delay, step 191 is not needed because in this embodiment we have exact synchronization.

Figure 12:
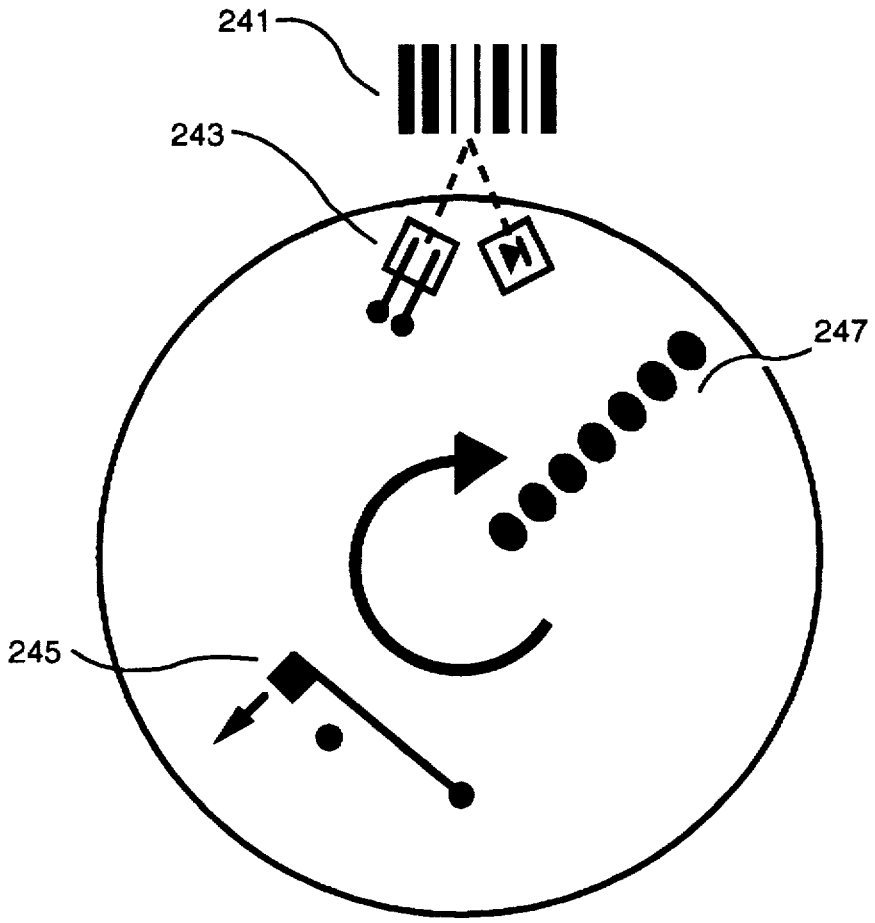
FIG. 12 is a diagram of a typical circuit board for an alternate embodiment of the present invention, a top used on a board game, with a bar code decoder for synchronization and message selection.

Referring next to FIG. 12, there is illustrated a diagram of a circuit board which may be used in an embodiment of the invention incorporated as a board game device. In this embodiment of the invention the device "reads" a bar code 241, or some other indicia, printed or otherwise located on a board game, and then outputs a display in accordance with the code read. In particular, the bar code serves two purposes: it provides an optical synchronization mechanism similar to the reed-switch mechanism described above in FIG. 10, and also can also be used to program the actual display output by specifying which message to be displayed or, in the alternative, by actually programming the content of a particular message. The bar code may also be used to indicate how fast and/or what direction the invention is rotating. The bar code may be decoded using a typical LED/photo transistor pair such as the optical sensor EE-SY310 from Omron. In this embodiment the output from the optical sensor serves in place of the synchronization switch 145 described in FIG. 5. The power supply circuit is again controlled by the centrifugal switch 245, and the LED's 247 are used as before.

Figure 13:
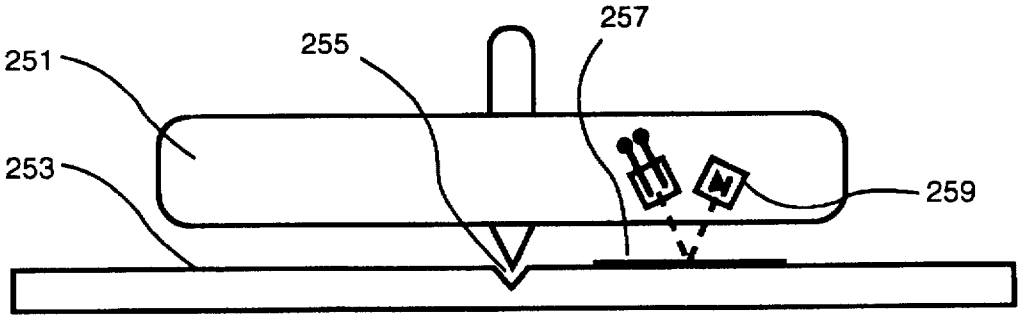
FIG. 13 is a side-view diagram of the top, the playing board, and the bar code according to the board game embodiment of the present invention.

Referring to FIG. 13, there is shown a cross-section of this embodiment of a board game device. The top 251 is spun on the playing board 253 in a specific area created by a shallow hole 255. The bar code 257 is printed so that is aligned with the reader 259. While a single bar code is shown, the playing board can be populated with many bar codes and holes arranged to provide many different combinations of inputs. In addition, by positioning the bar codes some distance apart from each other, two or more bar codes can be scanned at one location. It is also noted that while this embodiment uses bar codes, many other encoding schemes may be used, such as measuring the optical density of the ink. Also, while this embodiment provides an opportunity to program the device 'on-the-fly', in its simplest case, the bar code may simply be used as a synchronization signal similar to the reed-switch shown in FIG. 10.

Figure 14:
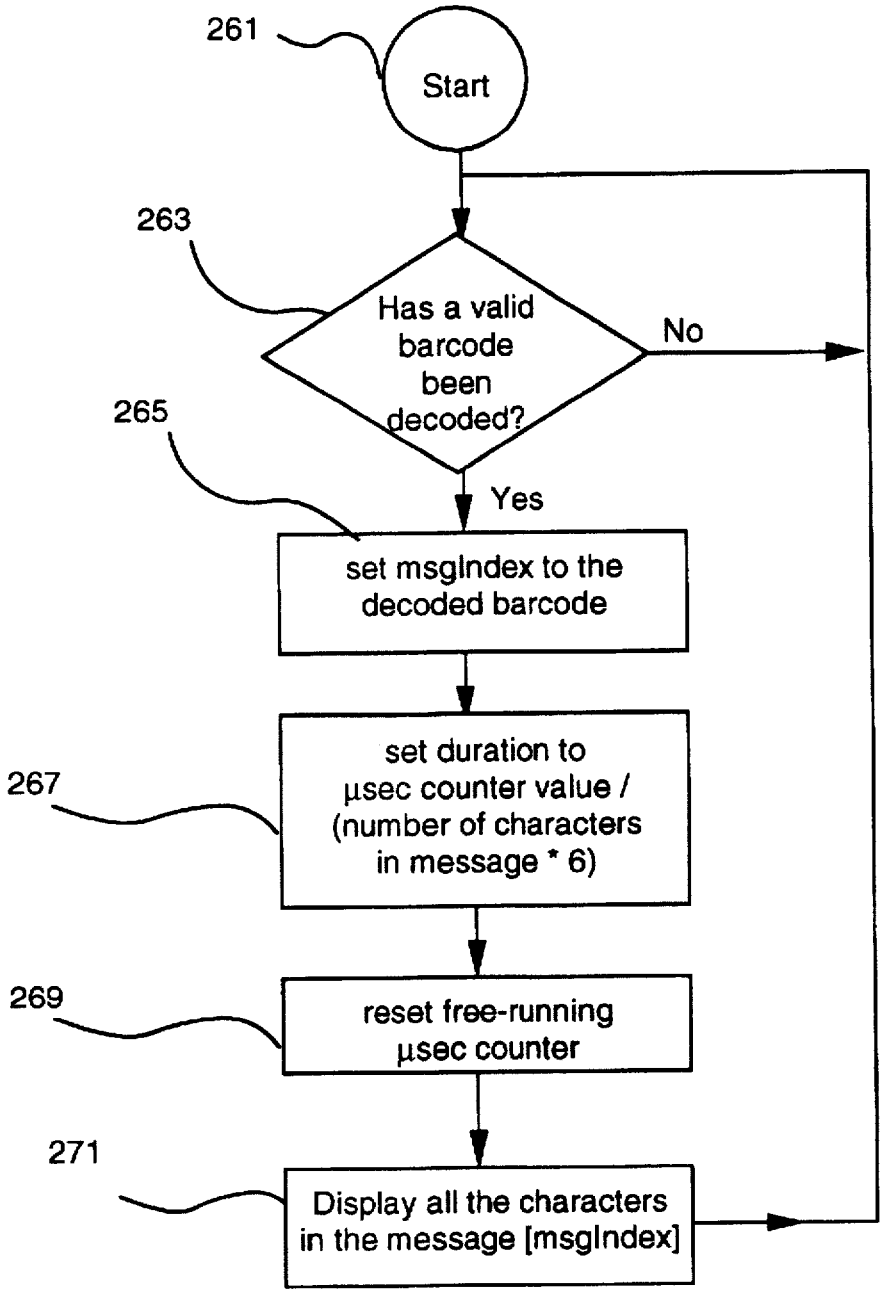
FIG. 14 is a flow chart illustrating the overall operating sequence according to the board game embodiment of the present invention.

Referring now to FIG. 14, there is shown the flowchart for the playing board embodiment of the present invention described above. Once again, this process builds upon that described in FIG. 11. In particular, the process begins when the microcontroller is reset at step 261. Step 263 forms a wait loop which loops until a valid bar code is decoded, which signifies the beginning of a new rotation. In this embodiment the bar code is also used to select which message to display 265, and that value is stored in msgIndex. As with steps 225 and 227 of FIG. 11, steps 267 and 269 calculate the duration of the LED illumination. Then, step 271 displays the chosen message as before. As noted, the bar code doesn't have to simply specify a message, but could specify an action such as picking a random number or pick a random message, etc., which would provide interesting game play which could change from game to game.

Figure 15:
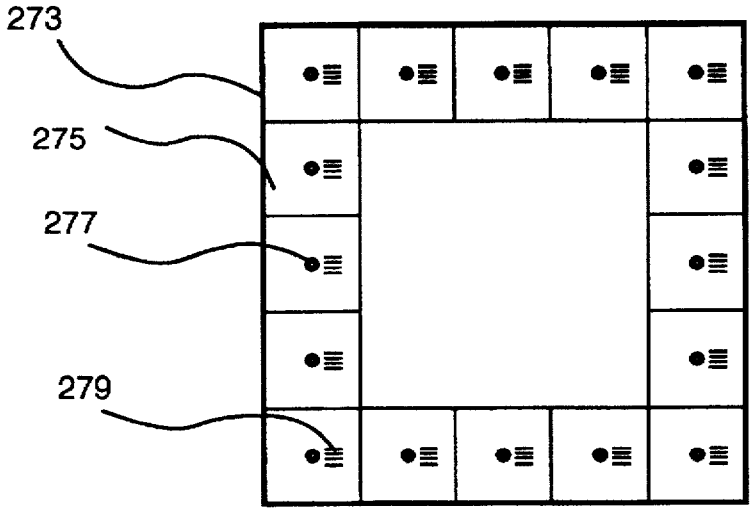
FIG. 15 is a top-view of a playing board with various bar codes distributed on the game squares according to the board game embodiment of the present invention.

Referring to FIG. 15, there is a top view of the playing board of a board game constructed in accordance with this embodiment. The playing board 273 is typical of many boards such as Monopoly® with squares that are visited according to the game play. In this embodiment, each square, such as 275, has the top spinning location created by the detent 277. Alongside each detent is at least one bar code 279. This diagram has representational bar codes, but in practice, the codes would be different in each square. Also, the arrangement of squares and whether each square has the bar code is a matter of design choice and can be varied according to the game play desired. The possibilities for rich and novel game play of this invention far exceed that of traditional dice and instruction cards.

Figure 16:
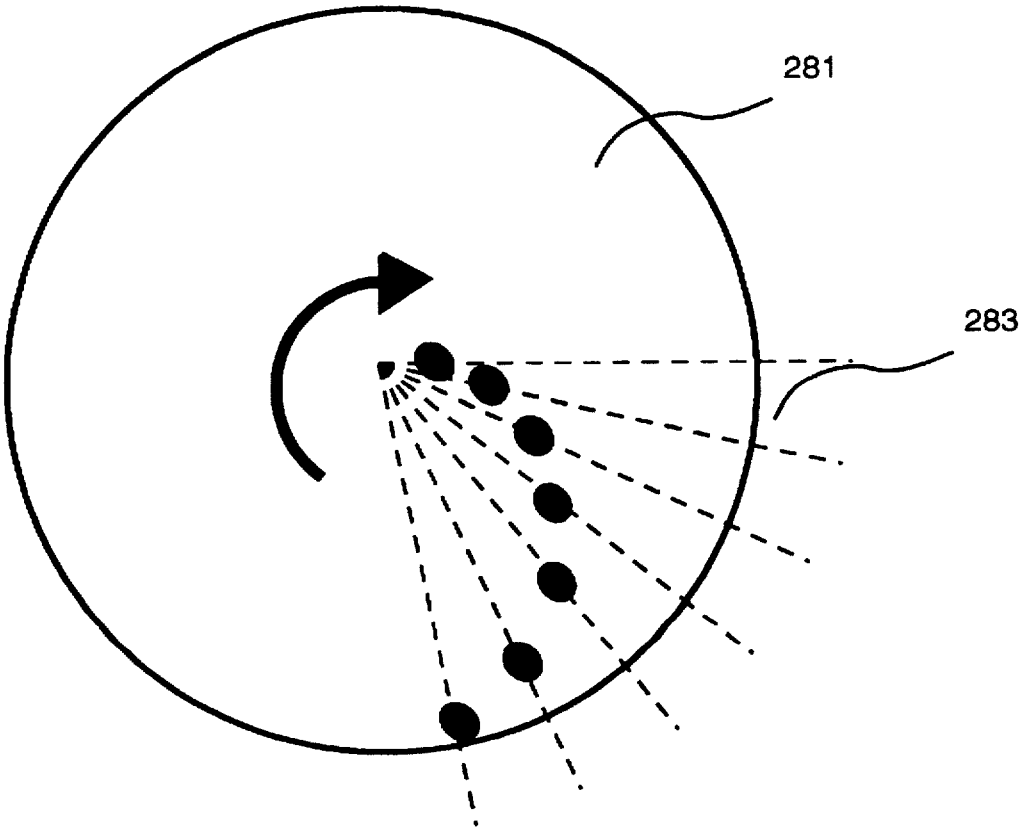
FIG. 16 is a partial diagram of a typical circuit board for an alternate embodiment of the present invention showing the LED's in a spiral arrangement.

In each of the embodiments illustrated so far, the arrangement of the LED display elements has been shown in a straight line. However, alternate layouts may also be used, resulting in additional operational advantages. In particular, referring to FIG. 16, there is shown a diagram of an alternate layout for the LED's. The circuit board 281 locates the LED's in a spiral 283 instead of a simple line illustrated earlier. The LED's are distributed on a specific angle which is determined by dividing a circle by total number of pixels displayed per rotation times the desired phase. In other words, if a message to be displayed is 20 characters long, the angle between pixels is 3°, derived as follows: 360°/(20*6). In this embodiment, the phase is six pixels, or one character so the angle shown is 18°. Other phases are, of course, possible. Distributing the LED's on a spiral permits the use of LED's with plastic packages that typically don't abut well. In some cases is It also makes the patterns produced more pleasant, when out of sync, e.g. kaleidoscopic.

Figure 17:
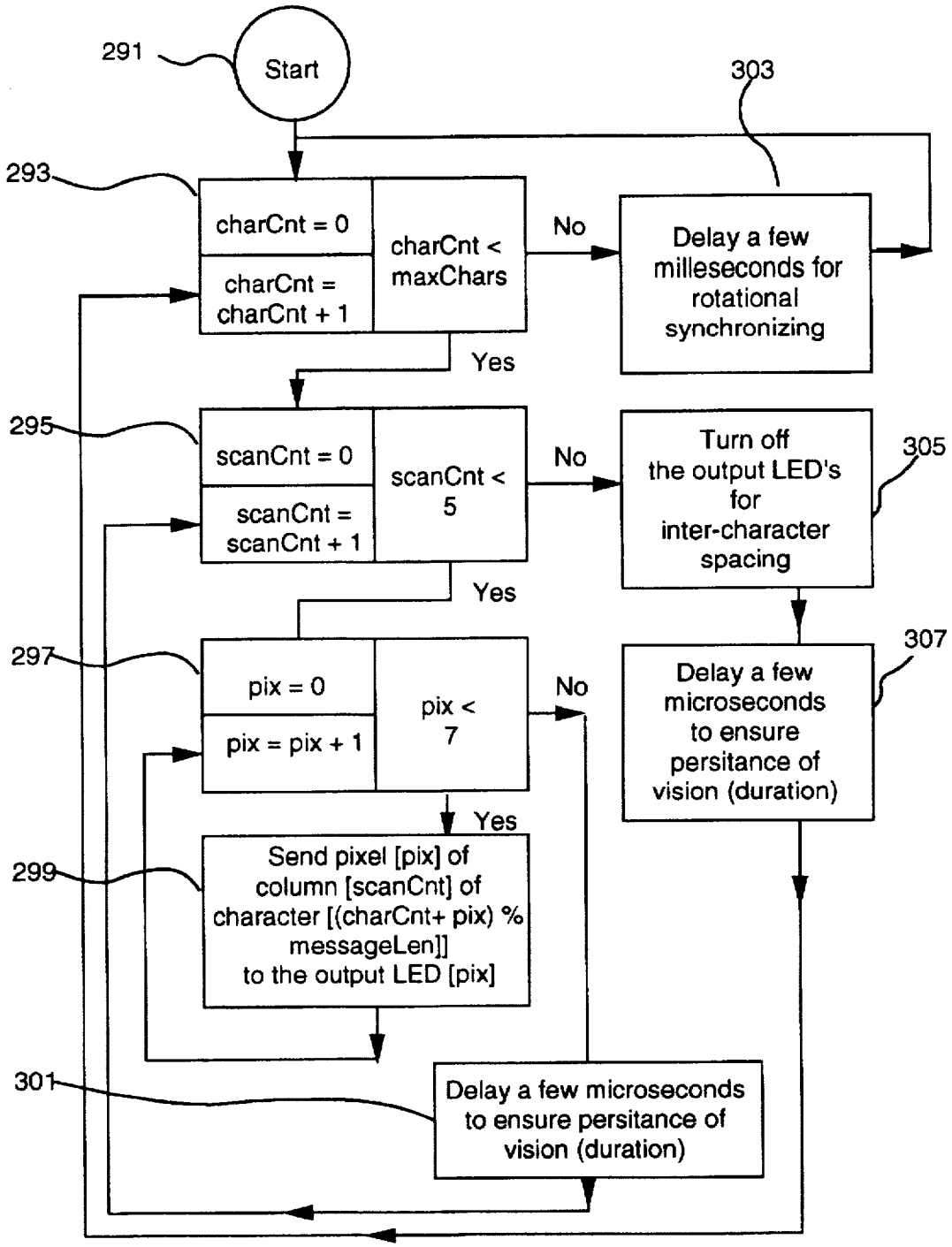
FIG. 17 is a flow chart illustrating the overall operating sequence according to the spiral arrangement embodiment of the present invention.

Referring now to FIG. 17, there is shown the flowchart for the present invention with an embodiment that has the LED's on 18° angles. This process is very similar to that shown in FIG. 9, but differs in a few important aspects. The process begins when the microcontroller is reset 291. For each character in the message, a loop is begun at step 293. The loop in step 295 is performed for each scan line, however in this embodiment since the pixels are distributed spatially, they must be individually turned on according to their respective characters. Step 297 loops for seven pixels, which is the character height chosen as an example for this embodiment. The LED's are each illuminated in turn 299; each turned on or off according the corresponding character and scan line. Since the phase in this case is one character, each LED is obtained from successive characters. Because of the non-linear character of the display, the index wraps so if "charCnt+pix" exceeds the message length, it wraps back around to the beginning of the message. The LED's are illuminated in step 301. The remaining scan lines are then displayed by returning to the loop in step 295. Once the scan lines are all displayed, an inter-character gap is displayed in step 305. After the character and its gap are displayed 307, the next character is started by returning to step 293. Finally, when the characters of the message have all been displayed, there is a few millisecond delay 303 before the whole process is repeated.

Figure 18:
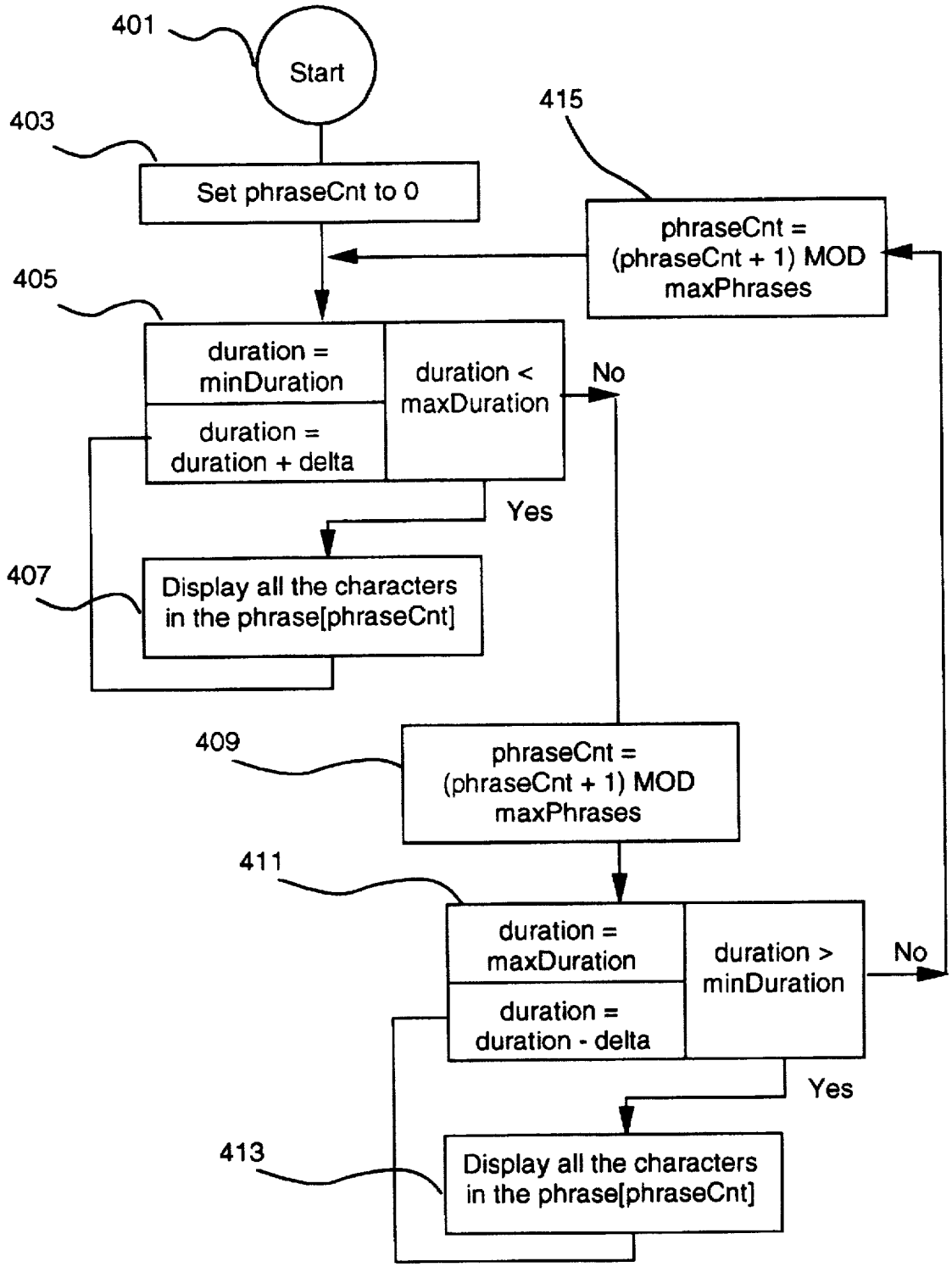
FIG. 18, is a flowchart for an embodiment that presents a varying message at a varying rate; and Appendix A is a source code listing of one embodiment of the invention written in the assembly language of a widely available microprocessor.

Finally, turning to FIG. 18, there is shown the flowchart for an embodiment that presents a varying message at a varying rate. By periodically sweeping the display rate between two values, the message will assuredly be correct at any given rotational speed. The message can also be changed at the limits of the display rate changes. The effect is to have a message magically appear and then become unreadable and then reappear with the next portion, etc., allowing for multiple messages (or parts of messages) to be displayed during a single spin. For example, in this embodiment the invention might be used as a 'fortune telling' device which would construct fortunes from a predefine database of phrases (nouns, adjectives, adverbs), resulting in a three stage display (such as "Your best friend" "will visit" "soon" or "A distant relative" "will telephone" "tomorrow"). Combined with the spiral layout of LED's, this implementation results in a very entertaining and novel display.

To understand this embodiment, reference is made to FIG. 18, where the microcontroller is reset at step 401. In this instance, there is a sentence made up of a plurality of phrases (maxphrases) which are indexed by phraseCnt. Sentence, as used in this description, means a long sequence of words and phrases means a partial sequence. The phrase counter is reset in step 403. Then the duration is set for this pass of display. The loop 405 sweeps through a range of durations from minimum to maximum. The limits are determined empirically by measuring the range of top speeds. The minimum is determined by the fastest top speed range and the maximum by the slowest top speed range. The specified phrase is displayed for the given duration 407. This embodiment uses the spiral layout for the LED's, therefore step 407 represents all the steps in FIG. 17 except 293 and 303. When the sweep from minimum to maximum duration is done, the next phrase is indexed 409. This flowchart documents a simple increment through phrases, but a random phrase could be selected here too. Step 411 is a similar loop to 405, but duration decreases back down to minDuration instead of increasing. The next step 413 is identical to step 407. Likewise, step 415 is the same process as step 409.

As indicated earlier, the invention may be realized using any number of different microprocessor technologies. In the present implementation of the invention a microcontroller such as the PIC16C56 manufactured by Microchip Technology Inc. of Chandler, Ariz. has been chosen because of its small size, low cost, and operational characteristics. In order to complete the disclosure of this invention, the assembly code for a spinning top embodiment of the invention is provided in APPENDIX A, the contents of which are incorporated here in by reference. This code is Copyright© 1995, 1996 by Noise Toys Inc. of Woodside, Calif., All Rights Reserved, and may not be used for any purposes other than to more completely understand the teachings of this patent.

Finally, it is understood that many additional variations and additional implementations may be made of the invention. For example, it is anticipated that sound may be provided in connection with the display, and that the sound may be synchronized to the display and may be selected according to the specific message which is displayed. It is also understood that while a single display assembly has been described in connection with each embodiment, multiple displays may also be used with a single device. For example, such a multiple display embodiment might be used with a slower rotation device, such as a bicycle, where the usual speed of a bicycle coupled with the persistence of vision might not be sufficient for a viewer to see an entire message. In addition, when incorporating multiple displays multiple color displays could also be used to provide additional display options. By way of example, a top may have two spirals located on opposite sides of the top's surface, and may use red and green LEDS to provide multicolored displays. The incorporation of RGB LED's would also allow for the display of full color images.

Additionally, it is anticipated that a further embodiment of the invention may include an option to alter the image or content of the image displayed in accordance with the direction of rotation. By way of example, most right handed people will tend to spin a top constructed in accordance with the teachings of the invention, in a 'clockwise' fashion. This assumption controls the 'left to right' clocking of characters across the display. However, one alternative embodiment of the invention utilizes a 'secret' message where incorporates a sensor to determine when the top is spun in a 'counter-clockwise' direction, altering the display to be correctly viewable or, in an entertaining fashion, to alter the display to display characters and/or animation in a backwards fashion.

Therefore, by practicing the teachings of the above described invention an electronic device may be constructed which adds to the enjoyment of common toys such as tops, yo-yo's, board games or wheeled vehicles by providing an animated display.

Accordingly, it will thus be seen that the objects set forth above, among those made apparent from the preceding description, are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It will also be understood that the following claims are intended to cover all of the generic and specific features of the invention, herein described, and all statements of the scope of the invention which, as a matter of language, might be said to fall there between.

What is claimed is:

1. A rotating toy incorporating an electronic display, comprising:

a rotational body;

a display mechanism disposed along at least a portion of one surface of said rotational body;

control circuitry for controlling the display of images on said display mechanism said images comprising at least one of a predefined group of letters or numbers or graphic characters;

a clock mechanism, coupled to said control circuitry, for refreshing the display of images on said display mechanism at a rate independent of the rotational speed of said rotational body; and an activation mechanism coupled to said control circuitry to activate the operation of said control circuitry, said activation mechanism being operable irrespective of the actual speed of rotation of said rotational body.

2. The rotating toy incorporating an electronic display, as claimed in claim 1 wherein said activation mechanism operates to initiate the operation of said control circuitry when said rotational body has exceeded at least a predetermined speed of rotation.

3. The rotating toy incorporating an electronic display, as claimed in claim 1, wherein said clock mechanism operates at a single fixed frequency such that the display is synchronized with the rotation of the rotational body at a single speed of rotation.

4. The rotating toy incorporating an electronic display, as claimed in claim 1, wherein said clock mechanism operates at a plurality of discrete fixed frequencies such that the display is synchronized with the rotation of the rotational body at a multiplicity of rotation speeds.

5. The rotating toy incorporating an electronic display, as claimed in claim 1, wherein said clock mechanism operates to continuously sweep through a predefined continuous range of frequencies, such that as the rotational speed of said rotating device decreases the display will first be unsynchronized, will then move into synchronization at a first speed of rotation, will then be unsynchronized once again, and will then move into synchronization at a second speed of rotation.

6. The rotating toy incorporating an electronic display, as claimed in claim 1, wherein said display mechanism comprises a plurality of Light Emitting Diodes.

7. The rotating toy incorporating an electronic display, as claimed in claim 6, wherein said plurality of Light Emitting Diodes are arranged along a curved path starting at a point proximate to the center of rotation and extending to a point proximate to a periphery of said rotating device.

8. The rotating toy incorporating an electronic display, as claimed in claim 5, wherein said control circuitry outputs a first predefined group of letters or numbers or graphic characters when said clock mechanism operates at a first frequency within said continuous range of frequencies, and further where said control circuitry outputs a second predefined group of letters or numbers or graphic characters when said clock mechanism operates at a second frequency within said continuous range of frequencies.

9. The rotating toy incorporating an electronic display, as claimed in claim 8, wherein said first predefined group of letters or numbers or graphic characters may be recognized by a viewer when said rotating device is rotated in a first direction and wherein said second predefined group of letters or numbers or graphic characters may be recognized by a viewer when said rotating device is rotated in a second direction.

10. A toy top comprising:

a rotational body;

a display mechanism disposed along at least a portion of one surface of said rotational body; and control circuitry for controlling the display of at least one predefined phrase on said display mechanism, said control circuitry further comprising a memory mechanism for storing a plurality of predefined phrases;

a selection mechanism for randomly selecting one of said plurality of predefined phrases for display on said display mechanism by said control circuitry; and a clock mechanism for refreshing the image on said display mechanism at a rate independent of the rotational speed of said rotational body; and an activation mechanism coupled to said control circuitry to activate the operation of said control circuitry, said activation mechanism being operable irrespective of the actual speed of rotation of said rotational body, and said activation mechanism operating to initiate operation of said control circuitry only when said rotational body has exceeded at least a predetermined speed of rotation.

11. The toy top, as claimed in claim 10, wherein said clock mechanism operates at a single fixed frequency.

12. The toy top, as claimed in claim 10, wherein said clock mechanism operates at a plurality of fixed frequencies.

13. The toy top, as claimed in claim 10, wherein said clock mechanism operates to sweep, at least once, through at least a portion of a predefined range of frequencies.

14. The toy top, as claimed in claim 13, wherein said control circuitry outputs a first predefined group of letters or numbers or graphic characters when said clock mechanism operates at a first frequency within said continuous range of frequencies, and further where said control circuitry outputs a second predefined group of letters or numbers or graphic characters when said clock mechanism operates at a second frequency within said continuous range of frequencies.

15. The toy top, as claimed in claim 14, wherein said first predefined group of letters or numbers or graphic characters may be recognized by a viewer when said rotating device is rotated in a first direction and wherein said second predefined group of letters or numbers or graphic characters may be recognized by a viewer when said rotating device is rotated in a second direction.

16. The toy top, as claimed in claim 10, wherein said second predefined group comprises the characters "PAUL IS DEAD".

* * * * *